US010697613B2

(12) United States Patent
Jou

(10) Patent No.: US 10,697,613 B2
(45) Date of Patent: Jun. 30, 2020

(54) LIGHT SOURCE GUIDING DEVICE WITH REFRACTING UNIT AND REFLECTING UNIT

(71) Applicant: Delta Electronics, Inc., Taoyuan (TW)

(72) Inventor: Chung-Min Jou, New Taipei (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/145,984

(22) Filed: Sep. 28, 2018

(65) Prior Publication Data

US 2019/0101262 A1 Apr. 4, 2019

(30) Foreign Application Priority Data

Sep. 28, 2017 (TW) ..... 106133290 A

(51) Int. Cl.

| | |
|---|---|
| ***F21V 5/04*** | (2006.01) |
| ***F21V 7/04*** | (2006.01) |
| ***F21V 5/08*** | (2006.01) |
| ***F21V 13/04*** | (2006.01) |
| *F21Y 115/10* | (2016.01) |

(52) U.S. Cl.

CPC ..... *F21V 5/046* (2013.01); *F21V 5/04* (2013.01); *F21V 5/08* (2013.01); *F21V 7/04* (2013.01); *F21V 13/04* (2013.01); *F21Y 2115/10* (2016.08)

(58) Field of Classification Search

CPC ..... F21V 13/04; F21V 5/04; F21V 5/08

See application file for complete search history.

(56) References Cited

U.S. PATENT DOCUMENTS

| | | | | |
|---|---|---|---|---|
| 9,574,746 | B2 * | 2/2017 | Broughton | F21V 5/04 |
| 2010/0014290 | A1 * | 1/2010 | Wilcox | F21V 5/04 362/244 |
| 2010/0302783 | A1 * | 12/2010 | Shastry | F21V 5/007 362/309 |

(Continued)

FOREIGN PATENT DOCUMENTS

| | | | |
|---|---|---|---|
| CN | 201568890 | U | 9/2010 |
| CN | 102803835 | A | 11/2012 |

OTHER PUBLICATIONS

Chinese Office Action based on corresponding Application No. 201811134350.1; dated Dec. 23, 2019.

*Primary Examiner* — Anh T Mai
*Assistant Examiner* — Michael Chiang
(74) *Attorney, Agent, or Firm* — Muncy, Geissler, Olds & Lowe, P.C.

(57) ABSTRACT

A light source guiding device comprises a light source refracting unit and a light source reflecting unit. The light source refracting unit receives a part of a light beam emitted by a light source, and the light source refracting unit utilizes geometric shapes disposed on inner and outer surfaces to form a rectangular light spot on a light-receiving surface by the part of the light beam. The light source reflecting unit receives another part of the light beam emitted by the light source, and the light source reflecting unit reflects the other part of the light beam emitted by the light source to form another rectangular light spot by using geometric shapes disposed on its surface, and the two rectangular light spots are overlapped with each other to enhance an illuminance of the rectangular light spot.

10 Claims, 9 Drawing Sheets

(56) References Cited

U.S. PATENT DOCUMENTS

| | | | | |
|---|---|---|---|---|
| 2012/0120666 | A1* | 5/2012 | Moeller | F21V 5/04 362/308 |
| 2014/0016326 | A1* | 1/2014 | Dieker | F21V 13/04 362/308 |
| 2017/0030557 | A1* | 2/2017 | Chen | F21V 13/04 |
| 2017/0254504 | A1* | 9/2017 | Mallory | F21V 5/007 |
| 2018/0231213 | A1* | 8/2018 | Kang | F21V 5/007 |
| 2019/0113205 | A1* | 4/2019 | Zhang | F21V 5/04 |

* cited by examiner

LIGHT SOURCE GUIDING DEVICE WITH REFRACTING UNIT AND REFLECTING UNIT

REFERENCE TO RELATED APPLICATIONS

The present application is based on, and claims priority from, Taiwan application number 106133290, filed Sep. 28, 2017, the disclosure of which is hereby incorporated by reference herein in its entirety.

BACKGROUND OF THE INVENTION

Field of the Invention

The present invention relates to optical lens and mirror, and more particularly to a light source guiding device that generates a rectangular light spot on a light-receiving surface through a lens by a part of a light source of a light-emitting diode, and forms another rectangular light spot on the light-receiving surface through a mirror by another part of the light source, with the two rectangular light spots overlapping with each other.

Description of the Prior Art

In recent years, light-emitting diodes (LEDs) with the advantages of high luminous efficiency, long service life, wide color gamut, short reaction time, small volume, and without mercury, have gradually replaced traditional lighting components, such as incandescent lamps, halogen lamps and even high-pressure sodium lamps, etc., and are widely used in various fields, such as applications in electronic products, home appliances or road lighting.

Conventionally, in the case of using a light-emitting diode illumination device, in order to effectively utilize the light beam emitted from the light-emitting diode, the light distribution of the light source of the light-emitting diode is usually realized by an optical lens. For example, in the Chinese utility model patent "lens of free-form surface for LED light source" (utility model patent publication number: CN201568890U), the optical lens comprises an inner surface of free-form surface and an outer surface of free-form surface, and the free-form surface is designed by an equiluminous grid method, each small grid of unequal size on the free-form surface of the outer surface corresponds to one of small rectangular grids with an equal area divided on a light-receiving surface, and the free surface of the inner surface is also divided into a same number of small grids of unequal size corresponding to the outer surface. The surface structure adopts a differential cloud point surface reconstruction method to provide a lens of free-form surface for LED light source with a light-emitting rectangular light spot, high luminous flux utilization efficiency, as well as high illuminance and uniformity.

However, the optical surface proposed in this patent is described by a nonlinear simultaneous partial differential equation. This equation generally has no analytical solution, it is necessary to use numerical methods to obtain a sufficiently accurate approximate solution in order to have value in usage. However, it is difficult to converge the numerical solution to be sufficiently accurate. So far, there is no good and efficient solution, and therefore it has not been able to configure an optical lens that efficiently and uniformly projects light beam onto a light-receiving surface, so this is an urgent problem to be solved.

For the asymmetric light type, for example, in the US patent "asymmetric area lighting lens" (patent publication no.: US2014/0016326A1), a lens is proposed which is mainly composed of a two refractive surfaces and a total reflection surface. A straight line is provided passing through a light source center, and a plane comprising the straight line is disposed. The first refractive curved surface is disposed on one side of the plane, and the second refractive curved surface and the total reflection surface are disposed on another side of the plane. A light-receiving surface is disposed at a certain point on the straight line and perpendicular to the straight line, the plane comprising the straight line divides the light-receiving surface into two regions, one of the regions is formed as a bright region on the side of the first refractive curved surface, and the other region is formed as a dark region on the side comprising the second refractive curved surface and the total reflection surface to form an asymmetric light pattern. The dark region is formed by using the second refractive curved surface and the total reflection surface to direct the light beam to the bright region light-receiving surface on the opposite side. At this point, an angle of the light beam that is refracted and totally reflected to pass through the straight line of the light source center is limited by a refractive index of the lens material, which is impossible to violate the refraction theorem, so the angle cannot be too large. The distribution of the light source energy on the light-receiving surface is asymmetrical, so it is difficult to form a uniform rectangular illuminance distribution. Therefore, it is not easy to use this method in an occasion, such as a giant billboard, where it is required to have a short distance between a lamp apparatus and an illuminated surface as well as an uniform rectangular illuminance. Therefore, it is an urgent problem to be solved.

SUMMARY OF THE INVENTION

In view of the difficulty in the configuration of the optical lens in the prior art, it is an object of the present invention to provide a configuration for an optical lens which is solved on the basis of a relatively simple first-order two-dimensional nonlinear ordinary differential equation, so that an extensive rectangular light spot with enhanced illuminance and uniform illuminance can be projected.

According to an object of the present invention, a light source guiding device is provided which comprises a light source refracting unit and a light source reflecting unit, wherein an inner surface of the light source refracting unit receives a part of a light beam emitted by a light source, and a geometric shape of an outer surface of the light source refracting unit projects the part of the light beam on a light-receiving surface to form a rectangular light spot on a side offset from a central axis of the light source, and the light source reflecting unit reflects another part of the light beam emitted by the light source by using a geometric shape of a side facing the light source to form another rectangular light spot, which is overlapped with the rectangular light spot formed by the light source refracting unit to enhance an illuminance of an asymmetric rectangular light spot.

Wherein, further comprising one or a combination of a light source shielding unit and a side refracting unit, wherein the light source shielding unit is disposed on a side of the light source reflecting unit facing the light source refracting unit, and a geometrical shape of the light source shielding unit is configured along a boundary position between the light source refracting unit and the light source reflecting unit for shielding the light beam leaked from the boundary position between the light source refracting unit and the light source reflecting unit, and the side refracting unit corresponds to the light source refracting unit configuration so that the light beam corresponding to the position of the light source refracting unit can be incident in a direction toward the light source refracting unit.

The present invention has one or more of the following advantages:

1. The light source refracting unit and the light source reflecting unit are used to effectively form an asymmetric rectangular light spot with better brightness and uniform illuminance on the light-receiving surface by the LED light source in the coverage area of the light source guiding device.

2. The light source shielding unit or the side refracting unit is used to shield the light beam leaked from the boundary position between the light source refracting unit and the light source reflecting unit to prevent the light beam of the light source refracting unit and the light source reflecting unit from forming a light-leakage area on the light-receiving surface.

BRIEF DESCRIPTION OF THE DRAWINGS

The techniques of present invention would be more understandable from the detailed description given herein below and the accompanying figures are provided for better illustration, and thus description and figures are not limitative for present invention, and wherein.

DETAILED DESCRIPTION OF THE INVENTION

Figure 1:
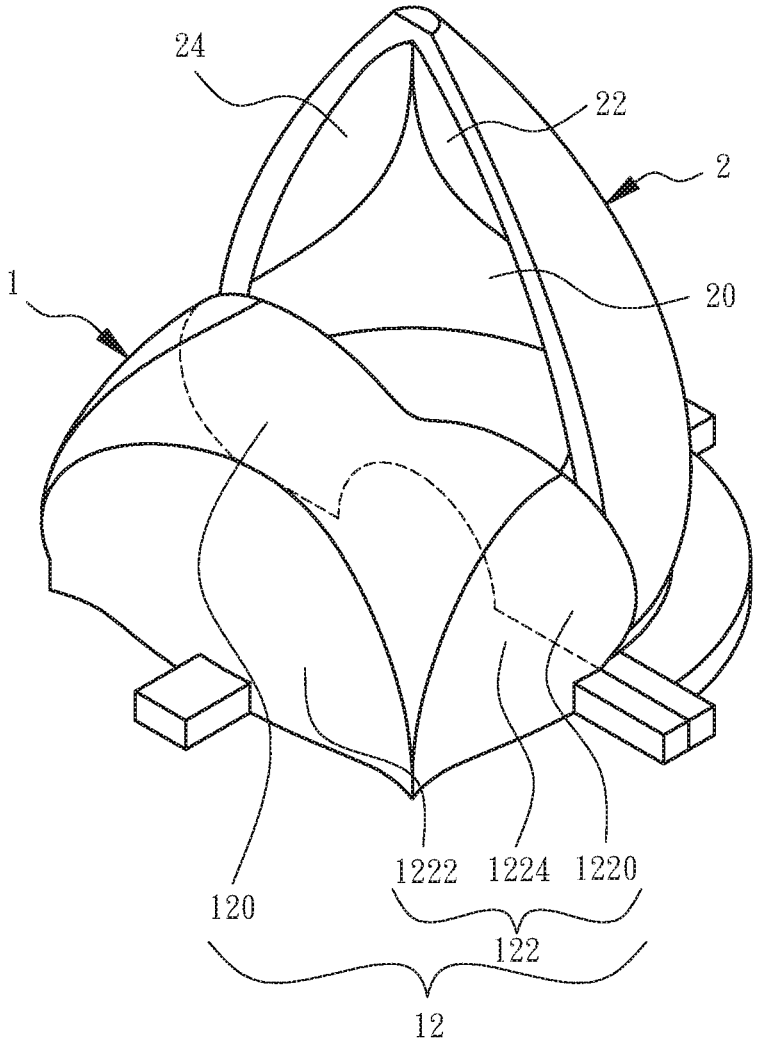
FIG. 1 is a perspective view of an embodiment of the present invention.
Figure 2:
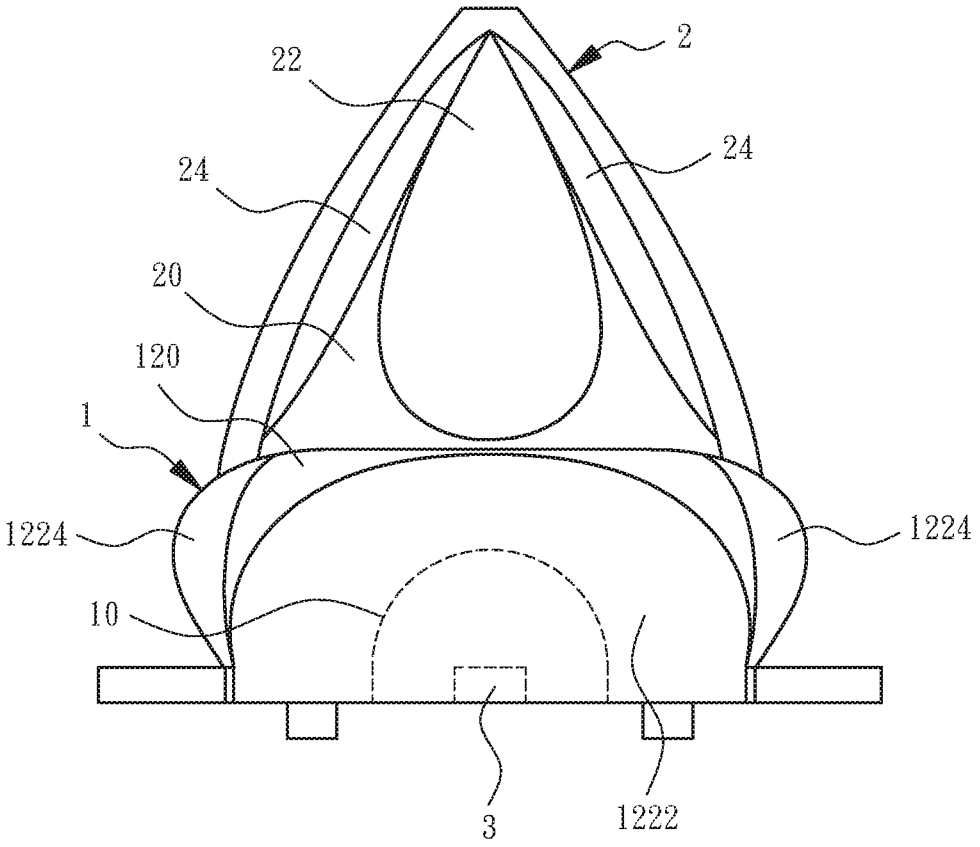
FIG. 2 is a front view of FIG. 1.
Figure 3:
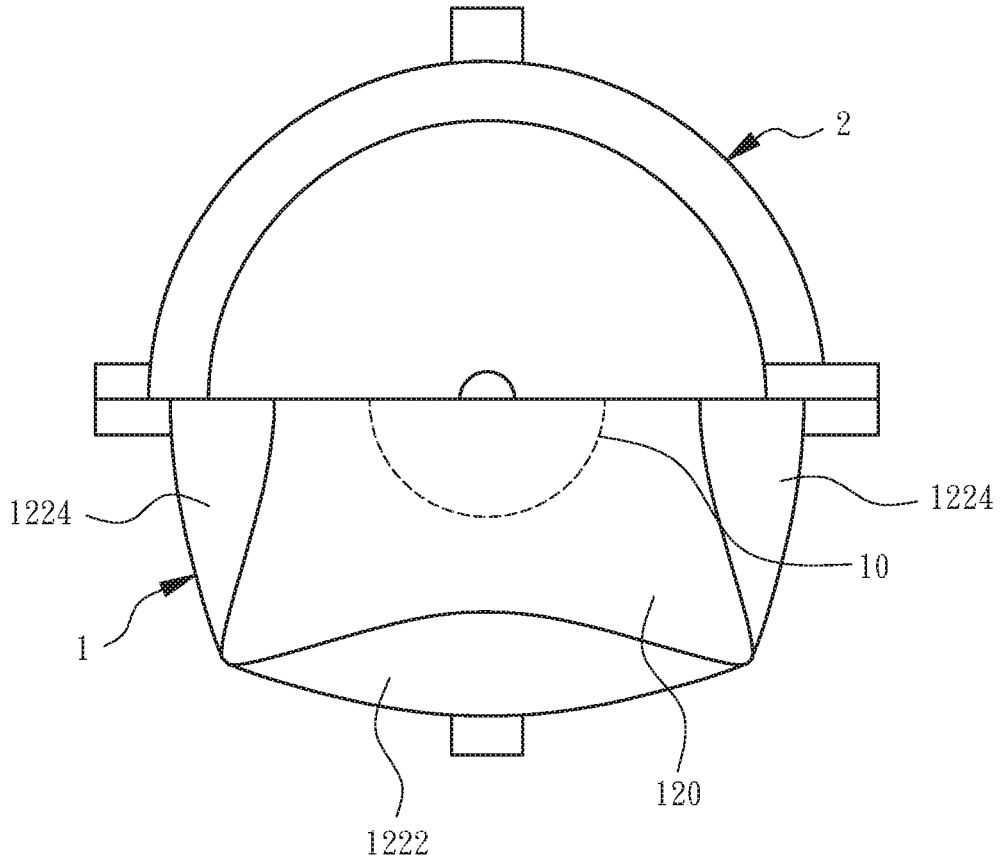
FIG. 3 is a top view of FIG. 1.
Figure 4:
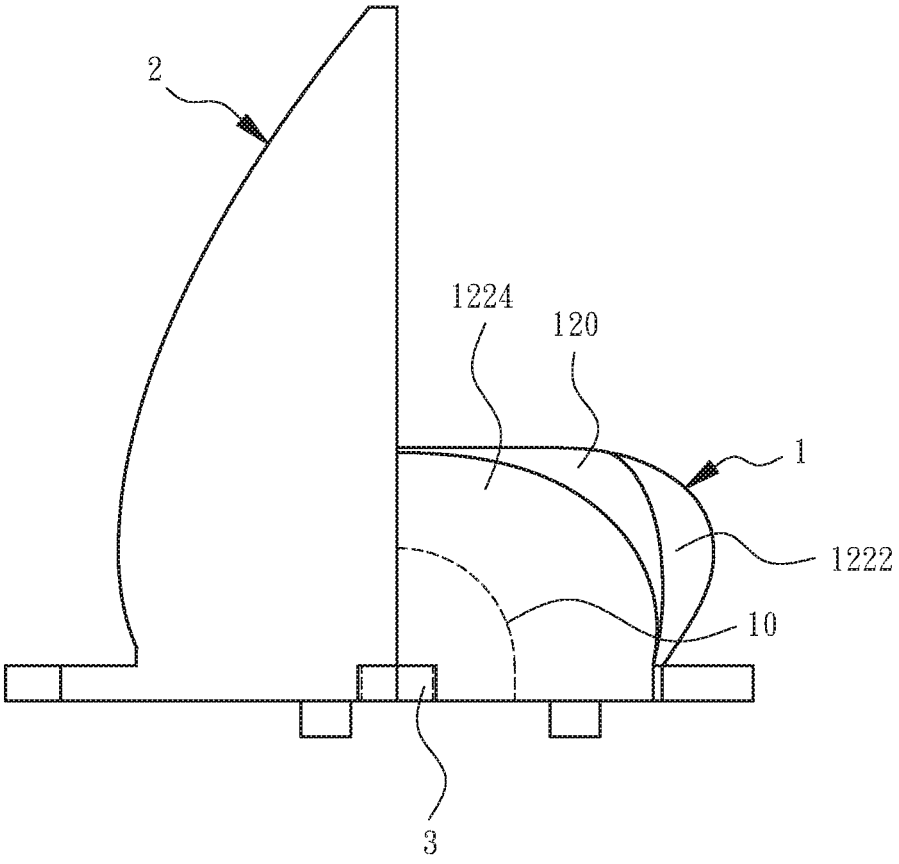
FIG. 4 is a side view of FIG. 1.

The invention will be described with reference to the accompanying drawings, and the embodiments of the present invention are described in detail below, and the drawings used in the text are used to describe the features, the contents and the advantages of the invention. The gist of the present invention is intended to be illustrative only and to assist in the specification, and is not intended to limit the scope of the invention in practice.

Referring to FIG. 1 to FIG. 4, the present invention is a light source guiding device, comprising a light source refracting unit 1 and a light source reflecting unit 2, the relationship between the two units and a light source as well as a light-receiving surface is as follows: a straight line is provided passing through a center of the light source, pointing to a direction of a largest light intensity of the light source or a direction in which a symmetry axis of light intensity is extended is called a light-emitting main axis 500, and is provided with a plane comprising the light-emitting main axis 500. The light source refracting unit 1 is disposed on one side of the plane, and the light source reflecting unit 2 is disposed on another side of the plane, and is provided with the light-receiving surface located at a certain point on a direction axis of the light source and perpendicular to the light-emitting main axis 500. The plane comprising the light-emitting main axis 500 divides the light-receiving surface into two regions. One of the regions on the light-receiving surface is formed as a bright region on the same side of the light source refracting unit 1 in order to form a light pattern of a rectangular light spot on a side offset from the light-emitting main axis 500. The other region is formed as a dark region on the same side of the light source reflecting unit 2, and the dark region is formed by using the light source reflecting unit 2 to form a light beam into another rectangular light spot that is guided to the bright region of the light-receiving surface. The light source refracting unit 1 and the light source reflecting unit 2 jointly receive the light beam emitted by the same light source, and an inner surface 10 of the light source refracting unit 1 receives a part of the light beam emitted by the light source of a light-emitting diode 3, preferably receiving one-half of the light beam emitted by the light source of the light-emitting diode 3. In addition, the light source reflecting unit 2 reflects another part of the light beam emitted by the light source by using a geometric shape of a side facing the light source, and reflects it to the bright region to form an asymmetric rectangular light spot. It can be known from the above that the two aforementioned rectangular light spots overlap each other, and the other part of the light beam emitted by the light source, preferably receiving the remainder one-half of the light beam emitted by the light source of the light-emitting diode 3, thereby enhancing the illuminance and uniformity of the asymmetric rectangular light spot.

In an embodiment of the present invention, the light source 4 can be a light-emitting diode (LED), the light-emitting diode 3 is disposed on a circuit board, and the light-emitting main axis 500 is a light source energy distribution center passing through the light-emitting diode 3, pointing to a direction in which the light source has the highest light intensity or a direction of a symmetry axis of the light intensity distribution. The light source refracting unit 1 is a geometric optical refraction lens made of a light-transmissive material such as glass, resin, crystal or acrylic, etc. An outer surface 12 comprises an upper surface portion 120 and a side surface portion 122, and the upper surface portion 120 is disposed at a position opposite to the inner surface 10. Wherein the inner surface 10 is a first axial symmetric curved surface, for example, one quarter of a spherical curved surface, formed by rotating a quadratic curve, such as hyperbola, parabola, ellipse or the like on a plane including the light-emitting main axis 500 about the light-emitting main axis 500 by 180 degrees. The upper surface portion 120 is a second axial symmetric curved surface formed by rotating another curve on the above-mentioned plane about the light-emitting main axis 500 by 180 degrees, so the light spot formed by the light beam emitted by the light source via the two axial symmetric curved surfaces is semicircular. A required rectangular range is first defined within the semicircular light spot, and a partial region of the optical path on the upper surface outside a boundary of the rectangular light spot is cut away, thereby forming a boundary of the upper surface portion 120, and the light beam projected by the boundary of the upper surface portion 120 is the boundary position of the rectangular light spot.

In the present invention, the side surface portion 122 surrounds between the upper surface portion 120 and the inner surface 10, and a boundary of the side surface portion 122 adjacent to the upper surface portion 120 and the boundary of the upper surface portion 120 are a common boundary, and the light beam passing the side surface portion 122 is respectively refracted within the boundary of the rectangular light spot of the bright region of the light-receiving surface. The side surface portion 122 further comprises a light-emitting surface 1220, a first refractive curved surface 1222 and a second refractive curved surface set 1224, the light-emitting surface 1220 is disposed at a position of the side surface portion 122 facing the light source reflecting unit 2, and the light-emitting surface 1220 is located above the plane passing through the light-emitting main axis 500 and dividing into the bright region and the dark region. The first refractive curved surface 1222 is a part composing the side surface portion 122 and is located at a position facing away from the light source reflecting unit 2, and the second refractive curved surface set 1224 is another part composing the side surface portion 122 and is disposed at a position between two corresponding surfaces of the light-emitting surface 1220 and the first refractive curved surface 1222. The first refractive curved surface 1222 and the second refractive curved surface set 1224 superimposedly project the light beam on the bright region of the light-receiving surface to enhance the illuminance of the rectangular light spot, and the light-emitting surface 1220 allows a part of the light beam to pass through and project to the light source reflecting unit 2.

In the present invention, the light source reflecting unit 2 is an optical mirror (for example, a metal coated mirror), and comprises a concave curved surface portion 20, a first reflective curved portion 22, and a second reflective curved portion 24. The concave curved surface portion 20 is disposed at a position of the light source reflecting unit 2 facing the light source refracting unit 1, and reflects another part of the light beam on the bright region of the light-receiving surface to form a rectangular light spot, which overlaps with the rectangular light spot obtained through the light source refracting unit 1. Furthermore, the concave curved surface portion 20 is a concave axial symmetric curved surface created by rotating a plane curve on the plane comprising the light-emitting main axis 500 about the light-emitting main axis 500 by 180 degrees, and then using three specific boundary curves on the concave axial symmetric curved surface to cut off the outer region to form a concave curved surface portion. The light beam reaching a boundary curve on the concave curved surface is reflected to reach three boundaries of the light spot to form a rectangular light spot which is overlapped with the rectangular light spot formed by the light source refracting unit 1. The first reflective curved portion 22 is disposed between the two second reflective curved portion 24 of the light source reflecting unit 2, and the second reflective curved portion 24 are disposed at positions of the light source reflecting unit 2 facing each other. The concave curved surface portion 20 shares a boundary with the first reflective curved portion 22 and the second reflective curved portion 24. The light beam projected through the boundary of the concave curved surface portion 20 is exactly the boundary of the rectangular light spot on the bright region of the light-receiving surface, and the light beam projected by the light source to the first reflective curved portion 22 and each of the second reflective curved portion 24 is respectively reflected within the boundary of the rectangular light spot of the bright region of the light-receiving surface to enhance the illuminance of the rectangular light spot.

Figure 5:
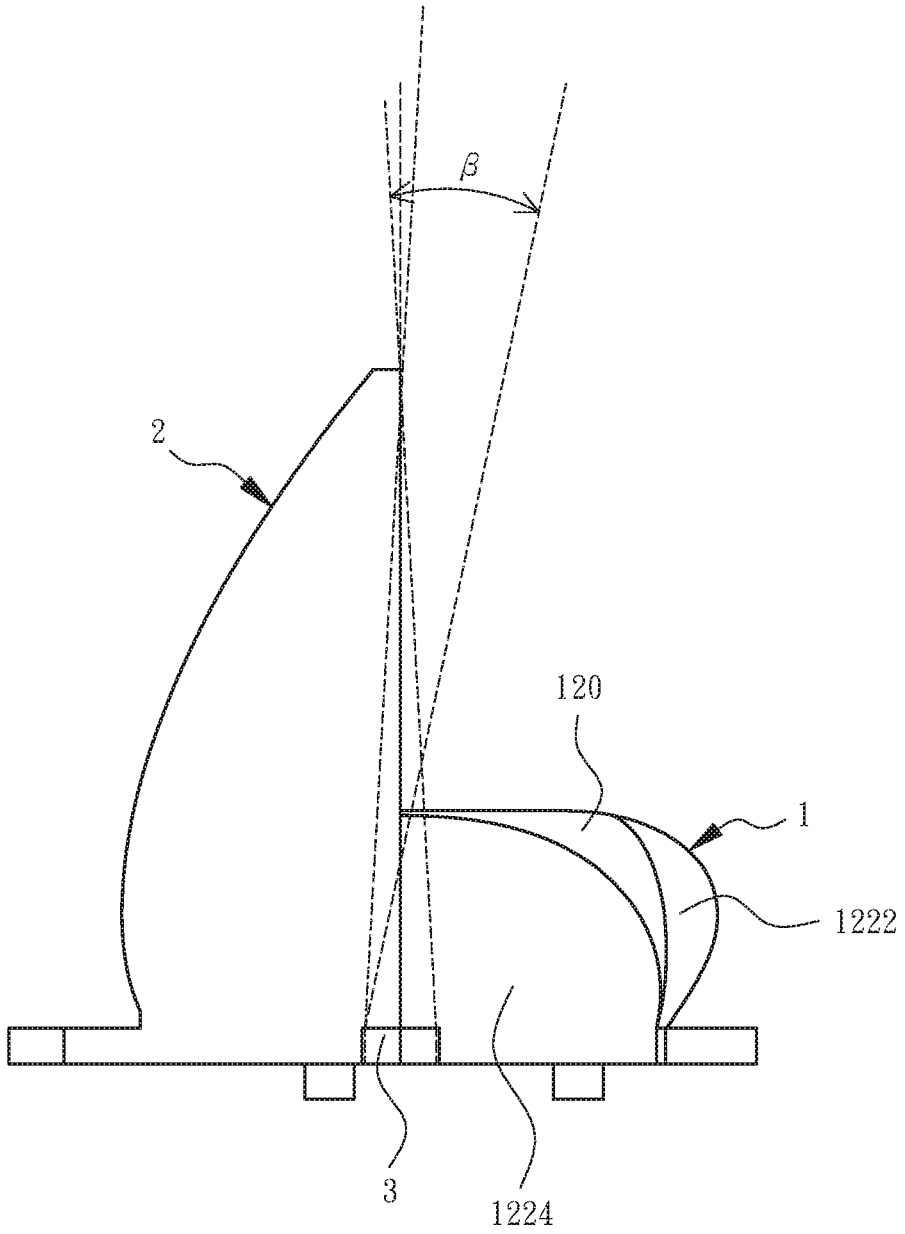
FIG. 5 is a schematic diagram of a light-leakage area between a light source refracting unit and a light source reflecting unit of FIG. 1.
Figure 6:
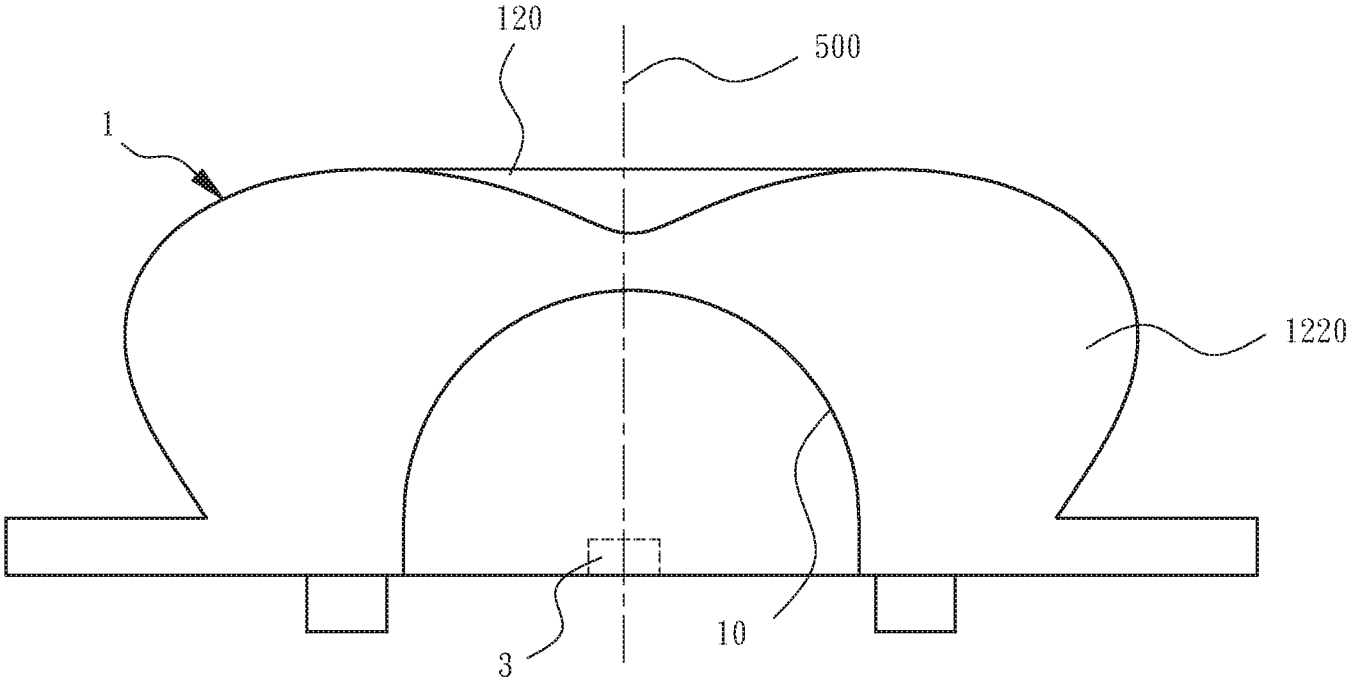
FIG. 6 is a schematic view of the light source refracting unit of FIG. 1.
Figure 7:
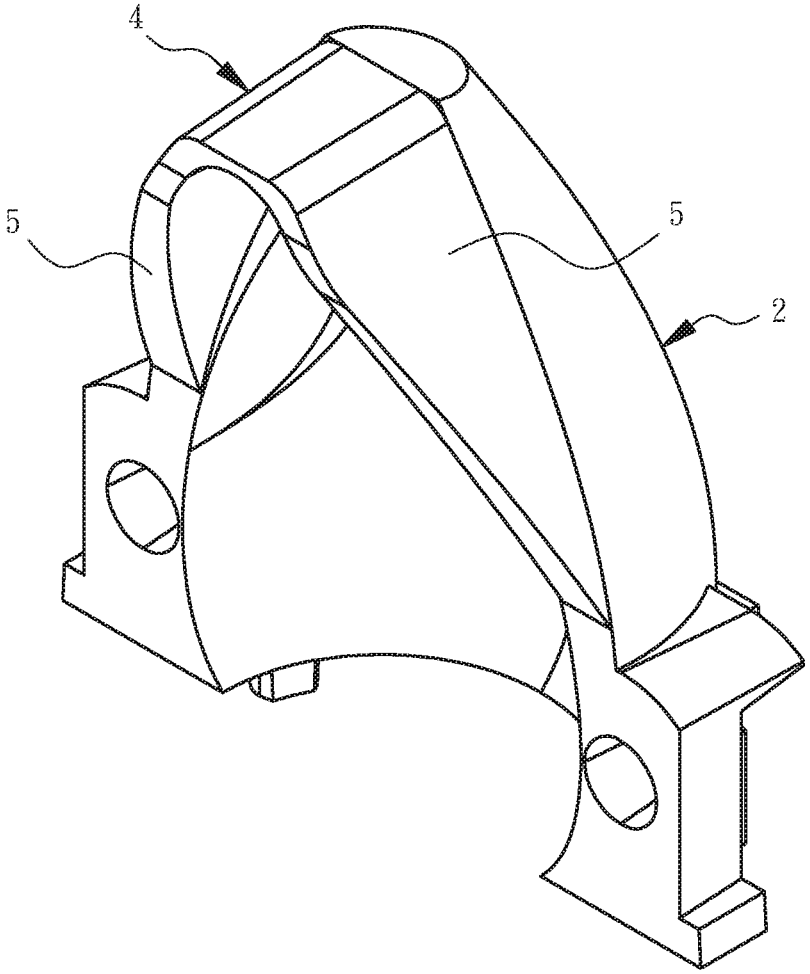
FIG. 7 is a perspective view of the light source reflecting unit and a side refracting unit according to another embodiment of the present invention.
Figure 8:
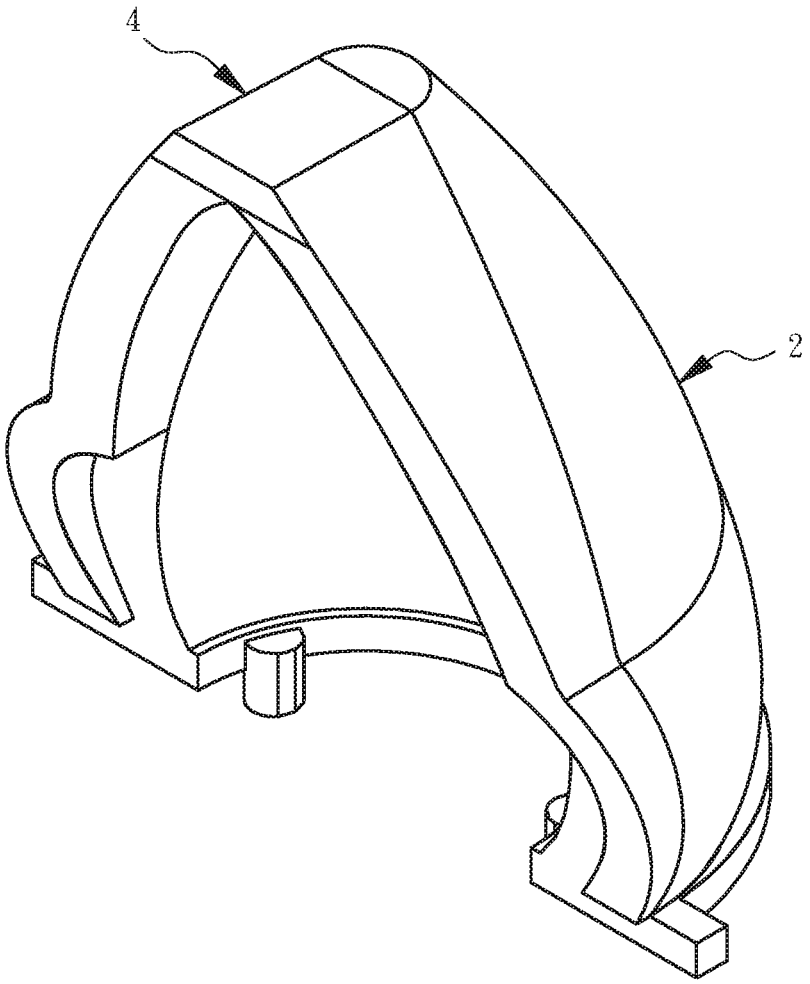
FIG. 8 is a perspective view of the light source reflecting unit and a light source shielding unit according to another embodiment of the present invention.

Referring to FIG. 5, since part of the light source is not covered by the light source refracting unit 1, and is opened for escaping via the light source reflecting unit 2, this will cause the light beam of the light source at the boundary position between the light source refracting unit 1 and the light source reflecting unit 2 to be directly projected onto the light-receiving surface to form a light-leakage region β. In order to solve this problem, referring to FIG. 7 in the present invention, the light source guiding device further comprises a light source shielding unit 4 or a side refracting unit 5. The light source shielding unit 4 or the side refracting unit 5 is disposed at an edge of the light source reflecting unit 2 facing the light source refracting unit 1. The light source shielding unit 4 is configured along the light-leakage region β adjacent the light source at a boundary position between the light source refracting unit 1 and the light source reflecting unit 2 for mainly shielding or dispersing the light beam of the light-leakage region β, thereby eliminating the light-leakage region β in order to avoid the occurrence of hot spots with strong illuminance on the rectangular light spot. A geometric shape of the side refracting unit 5 corresponds to the configuration of the light source refracting unit 1 and is used in such a way that the light beam leaked from a part of the configuration of the light source reflecting unit 2 not corresponding to the light source refracting unit 1 is incident toward the direction of the light source refracting unit 1. The light source shielding unit 4, the side refracting unit 5, and the light source reflecting unit 2 can be integrally formed.

Figure 9:
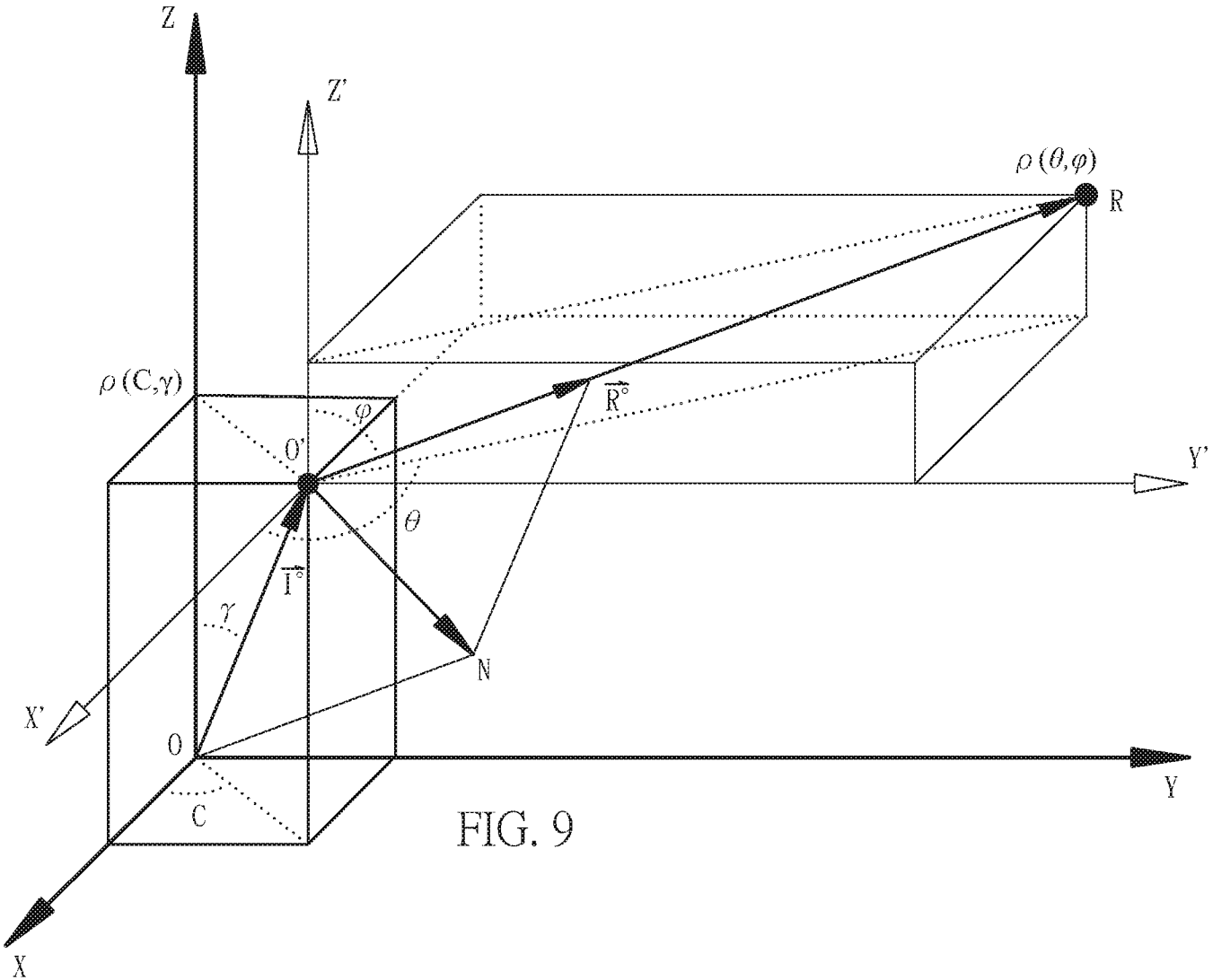
FIG. 9 is a schematic diagram of a coordinate system of an equation.

Please refer to FIG. 9, which is a schematic diagram of a light source projection and a coordinate system of an equation at any position on the upper surface portion of the light source guiding device of the present invention, wherein O is a center position of the light source, O' is a position of any point of a reflecting or refracting surface, and R is a target position on the light-receiving surface. The light beam starts from O to reach the optical surface O', and is refracted or reflected to reach the target point R. If the coordinate origin O in the Cartesian coordinate system is a center of the C-γ spherical coordinate system, then any point O' on the free-form surface can be expressed as ρ(C, γ), the angle C is an included angle between the projection of a vector OO' on a XOY plane and the positive direction of the X-axis, and the angle γ is an included angle between the vector OO' (unit vector: $\vec{I}^{\circ}$) and the positive direction of the Z axis; if the point O' is the center of the spherical coordinate system, then a reflected light beam vector O'R (unit vector: $\vec{R}^{\circ}$) can be expressed as ρ(θ, φ), wherein the angle θ is an included angle between the projection of the vector O'R on the XOY plane and the positive direction of the X-axis, the angle φ is an included angle between the vector O'R and the positive direction of the Z-axis. It is assumed that the point O' is an arbitrary point on the free-form surface, which can be expressed as O(x, y, z) in the three-dimensional Cartesian coordinate system, and expressed as ρ(C, γ) in the spherical coordinate system, in the case of axial symmetric (θ−C)=0 or a constant, then equation (1) is established:

$$\frac{\partial \rho}{\partial \gamma} = \rho \frac{n_R \sin\gamma \cos\varphi - n_R \cos\gamma \sin\varphi \cos(\theta - C)}{n_R \cos\gamma \cos\varphi + n_R \sin\gamma \sin\varphi \cos(\theta - C) - n_I}. \quad \text{Equation (1)}$$

The relationship between γ and φ is governed by the law of conservation of energy to determine the unique relationship between the two, so that the two variables become dependent, so the equation can be uniquely solved. This relationship determines the form of illuminance distribution on the light-receiving surface. The energy of the light source is transferred to the light-receiving surface to obtain a set light intensity distribution. As described above, since the upper surface portion 120 of the light source refracting unit 1 and the concave curved surface portion 20 of the light source reflecting unit 2 of the present invention are axial symmetric curved surfaces, the establishment of a created curve of the two symmetric surfaces can be expressed by the differential equation 1. The other refracting surfaces and reflecting surfaces of the present invention can define sectional curve sets of a plurality of different positions by Equation 1, and the refracting or reflecting surfaces can be respectively constructed by the sectional curve sets.

Wherein when (θ−C) is a constant representing a certain plane containing the axis of symmetry, the plane curve represented by the equation is on the plane, wherein $n_I$, $n_R$ are refractive indexes of a medium where the incident light and the emergent light are, when it is refracted, $n_I \neq n_R$, when it is totally reflected $n_I = n_R \neq 1$, in the air is $n_1 = n_R = 1$, normal vector N of an arbitrary point on the free-form surface can be expressed by the unit vector $\vec{I}^{\circ}$ of the incident light beam and the unit vector $\vec{R}^{\circ}$ of the reflected light beam. From the point of view of Equation 1, the geometric curved surface of the present invention is a two-dimensional spatial solution method, which is simpler than the prior art three-dimensional spatial solution method of the nonlinear partial differential equation, which solves the problem that the traditional partial differential equation is difficult to solve, and can project the light beam of the light source onto the light-receiving surface efficiently and uniformly or according to the set illuminance distribution. A method of modifying the axial symmetric surface is also proposed to obtain a rectangular light spot on the light-receiving surface.

In summary, the present invention can achieve projecting the rectangular light spots on the light-receiving surface by using simpler differential equation solution, and the light source refracting unit 1 and the light source reflecting unit 2 respectively refract and reflect by using half of the light source, so that the present invention can distribute the energy of the light source onto the light-receiving surface more uniformly or according to the set illuminance. In addition, the light-leakage area β is eliminated by the light source shielding unit 4, and the side refracting unit 4 is used in such a way that the leaked light beam of a part of the configuration of the light source reflecting unit 2 not corresponding to the light source refracting unit 1 is incident toward the direction of the light source refracting unit 1 in order to avoid the occurrence of hot spots with strong illuminance on the rectangular light spot.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A light source guiding device, comprising:

a light source refracting unit, an inner surface of the light source refracting unit receiving a part of a light beam emitted by a light source, and a geometric shape of an outer surface of the light source refracting unit projects the part of the light beam on a light-receiving surface to form a rectangular light spot on a side offset from a light-emitting main axis, wherein the light-emitting main axis is a direction of a largest light intensity of the light source, or a symmetry axis of the largest light intensity of the light source, wherein the largest light intensity of the light source is a center of the light source; and a light source reflecting unit, by using a geometric shape of a side facing the light source, the light source reflecting unit reflects another part of the light beam emitted by the light source on the same light-receiving surface to form an other rectangular light spot, and the other rectangular light spot is overlapped with the rectangular light spot formed by the light source refracting unit.

2. The light source guiding device as claimed in claim 1, wherein the light source is a light-emitting diode, and the light-emitting diode is disposed on a circuit board.

3. The light source guiding device as claimed in claim 1, wherein the light source refracting unit comprises:

the inner surface being an axial symmetric curved surface, the axial symmetric curved surface is a first axial symmetric curved surface created by rotating a plane curve on a plane including the light-emitting main axis about the light-emitting main axis by 180 degrees, and a light beam emitted by the light source enters the light source refracting unit from the inner surface; and an outer surface, comprising:

an upper surface portion, the upper surface portion is opposite to the inner surface, the upper surface portion is included in a curved surface, the curved surface is a second axial symmetric curved surface created by rotating a plane curve about the light-emitting main axis by 180 degrees, the created plane curve of the upper surface portion is coplanar with the created plane curve of the inner surface, a part of the light beam of the light source forms a semicircular light spot via axial symmetric surfaces with the light-emitting main axis as an axis formed by the inner surface and the upper surface portion, three regions of the second axial symmetric surface are cut off to form a boundary of the upper surface portion, and the light beam projected by the boundary of the upper surface portion is a boundary position of the rectangular light spot; and a side surface portion extending between the upper surface portion and the inner surface, a boundary of the side surface portion adjacent to the upper surface portion and the boundary of the upper surface portion are a common boundary, and the light beam passing through the side surface portion is respectively refracted within the boundary of the rectangular light spot of the light-receiving surface, the side surface portion further comprises:

a light-emitting surface, the light-emitting surface is disposed at a position of the side surface portion facing the light source reflecting unit, and the light-emitting surface is disposed above a plane comprising the light-emitting main axis, the plane divides the light-receiving surface into a bright region and a dark region, wherein the bright area is formed by the two rectangular light spots projecting on the light-receiving surface;

a first refractive curved surface is a part composing the side surface portion and is located at a position facing away from the light source reflecting unit; and a second refractive curved surface is another part composing the side surface portion and is disposed at a position between two corresponding surfaces of the light-emitting surface and the first refractive curved surface;

wherein the first refractive curved surface and the second refractive curved surface superimposedly project the light beam on the bright region of the light-receiving surface to enhance the illuminance of the rectangular light spot, and the light-emitting surface allows a part of the light beam to pass through and project to the light source reflecting unit.

4. The light source guiding device as claimed in claim 3, wherein the light source reflecting unit comprises:

a concave curved surface portion being a concave axial symmetric curved surface created by rotating a plane curve on the plane of the light-emitting main axis about the light-emitting main axis by 180 degrees, and then using three specific boundary curves on the concave axial symmetric curved surface to cut off an outer region to form the concave curved surface portion, the light beam reaching a boundary curve on the concave curved surface is reflected to reach three boundaries of the rectangular light spot to form the other rectangular light spot and overlap with the rectangular light spot formed by the light source refracting unit, wherein the outer region is located at outside of three specific boundary curves on the concave axial symmetric curved surface;

a first reflective curved portion, the first reflective curved portion is disposed at a position of the light source reflecting unit facing toward the light-emitting surface of the light source refracting unit; and a second reflective curved portion, and the second reflective curved portion is respectively disposed by one side of the first reflective curved portion;

wherein the concave curved surface portion shares a boundary with the first reflective curved portion and the two second reflective curved portion, and the light beam reaching the first reflective curved portion and each of the second reflective curved portion is respectively reflected within the boundary of the rectangular light spot of the light-receiving surface.

5. The light source guiding device as claimed in claim 4, wherein the light source at any position on the concave curved surface portion of the light source guiding device is projected on a coordinate system of an equation, wherein O is a center position of the light source, O' is a position of any point of a reflecting or refracting surface, and R is a target position on the light-receiving surface, the light beam starts from O to reach an optical surface O', and is refracted or reflected to reach the target point R, when the coordinate origin O in the Cartesian coordinate system is a center of the C-γ spherical coordinate system, any point O' on the free-form surface can be expressed as ρ(C, γ), the angle C is an included angle between the projection of a vector OO' on a XOY plane and the positive direction of the X-axis, and the angle γ is an included angle between the vector OO' and the positive direction of the Z axis; when the point O' is the center of the spherical coordinate system, a reflected light beam vector O'R can be expressed as ρ(θ, φ), wherein the angle θ is an included angle between the projection of the vector O'R on the XOY plane and the positive direction of the X-axis, the angle φ is an included angle between the vector O'R and the positive direction of the Z-axis, when the point O' is an arbitrary point on the free-form surface, which can be expressed as O(x, y, z) in the three-dimensional Cartesian coordinate system, and expressed as ρ(C, γ) in the spherical coordinate system, in the case of axial symmetric (θ−C)=0 or a constant, wherein the creation of a plane curve of the concave curved surface portion of the light source reflecting unit is expressed by the following differential equation:

$$\frac{\partial\rho}{\partial\gamma}=\rho\frac{n_R\sin\gamma\cos\varphi-n_R\cos\gamma\sin\varphi\cos(\theta-C)}{n_R\cos\gamma\cos\varphi+n_R\sin\gamma\sin\varphi\cos(\theta-C)-n_I}$$

when (θ−C) is a constant, the equation represents the plane curve on the plane comprising the light-emitting main axis, the plane curve is rotated around the light-emitting main axis to generate an axial symmetric surface, the concave curved surface portion is included in the axial symmetric surface, wherein $n_I$, $n_R$ are respectively refractive indexes of a medium where an incident light and an emergent light are, $n_I=n_R=1$, and the relationship between γ and φ is governed by the law of conservation of energy to determine the unique relationship between the two, so that the γ and φ variables become dependent, and the equation can be uniquely solved to determine the form of illuminance distribution on the light-receiving surface, and transfer the energy of the light source to the light-receiving surface for obtaining a set light intensity distribution.

6. The light source guiding device as claimed in claim 4, wherein a coordinate system of an equation at any position on the first reflective curved portion and the second reflective curved portion of the light source guiding device, wherein O is a center position of the light source, O' is a position of any point of a reflecting or refracting surface, and R is a target position on the light-receiving surface, the light beam starts from O to reach an optical surface O', and is refracted or reflected to reach the target point R, when the coordinate origin O in the Cartesian coordinate system is a center of the C-γ spherical coordinate system, any point O' on the free-form surface can be expressed as ρ(C, γ), the angle C is an included angle between the projection of a vector OO' on a XOY plane and the positive direction of the X-axis, and the angle γ is an included angle between the vector OO' and the positive direction of the Z axis: when the point O' is the center of the spherical coordinate system, a reflected light beam vector O'R can be expressed as ρ(θ, φ), wherein the angle θ is an included angle between the projection of the vector O'R on the XOY plane and the positive direction of the X-axis, the angle φ is an included angle between the vector O'R and the positive direction of the Z-axis, when the point O' is an arbitrary point on the free-form surface, which can be expressed as O(x, y, z) in the three-dimensional Cartesian coordinate system, and expressed as ρ(C, γ) in the spherical coordinate system, in the case of axial symmetric (θ−C)=0 or a constant, wherein the creation of a plane curve set of the first reflective curved portion and the second reflective curved portion set of the light source reflecting unit is defined by the following differential equation:

$$\frac{\partial\rho}{\partial\gamma}=\rho\frac{n_R\sin\gamma\cos\varphi-n_R\cos\gamma\sin\varphi\cos(\theta-C)}{n_R\cos\gamma\cos\varphi+n_R\sin\gamma\sin\varphi\cos(\theta-C)-n_I}$$

when (θ−C) is a constant, the equation represents the plane curve on the plane comprising the light-emitting main axis, the created plane curve of a plurality of different positions compose sectional curve sets of the first reflective curved portion and the second reflective curved portion set, the first reflective curved portion and the second reflective curved portion set are respectively constructed by the sectional curve sets, wherein $n_I$, $n_R$ are respectively refractive indexes of a medium where an incident light and an emergent light are, when it is reflected, $n_I=n_R=1$, and the relationship between γ and φ is governed by the law of conservation of energy to determine the unique relationship between the two, so that the γ and φ variables become dependent, and the equation can be uniquely solved to determine the form of illuminance distribution on the light-receiving surface, and transfer the energy of the light source to the light-receiving surface for obtaining a set light intensity distribution.

7. The light source guiding device as claimed in claim 3, wherein the light source at any position on the upper surface portion of the light source guiding device is projected on a coordinate system of an equation, wherein O is a center position of the light source, O' is a position of any point of a reflecting or refracting surface, and R is a target position on the light-receiving surface, the light beam starts from O to reach an optical surface O', and is refracted or reflected to reach the target point R, when the coordinate origin O in the Cartesian coordinate system is a center of the C-γ spherical coordinate system, any point O' on the free-form surface can be expressed as ρ(C, γ), the angle C is an included angle between the projection of a vector OO' on a XOY plane and the positive direction of the X-axis, and the angle γ is an included angle between the vector OO' and the positive direction of the Z axis; when the point O' is the center of the spherical coordinate system, a reflected light beam vector O'R can be expressed as ρ(θ, φ), wherein the angle θ is an included angle between the projection of the vector O'R on the XOY plane and the positive direction of the X-axis, the angle φ is an included angle between the vector O'R and the positive direction of the Z-axis, when the point O' is an arbitrary point on the free-form surface, which can be expressed as O(x, y, z) in the three-dimensional Cartesian coordinate system, and expressed as ρ(C, γ) in the spherical coordinate system, in the case of axial symmetric (θ−C)=0 or a constant, wherein the creation of a plane curve of the upper surface portion of the light source refracting unit is expressed by the following differential equation:

$$\frac{\partial\rho}{\partial\gamma}=\rho\frac{n_R\sin\gamma\cos\varphi-n_R\cos\gamma\sin\varphi\cos(\theta-C)}{n_R\cos\gamma\cos\varphi+n_R\sin\gamma\sin\varphi\cos(\theta-C)-n_I}$$

when (θ−C) is a constant, the equation represents the plane curve on the plane comprising the light-emitting main axis, the plane curve is rotated around the light-emitting main axis to generate an axial symmetric surface, the upper surface portion is included in the axial symmetric surface, wherein $n_I$, $n_R$ are respectively refractive indexes of a medium where an incident light and an emergent light are, $n_I \neq n_R$, and the relationship between γ and φ is governed by the law of conservation of energy to determine the unique relationship between the two, so that the γ and φ variables become dependent, and the equation can be uniquely solved to determine the form of illuminance distribution on the light-receiving surface, and transfer the energy of the light source to the light-receiving surface for obtaining a set light intensity distribution.

8. The light source guiding device as claimed in claim 3, wherein the light source at any position on the first refractive curved surface and the second refractive curved surface set of the light source guiding device is projected on a coordinate system of an equation, wherein O is a center position of the light source, O' is a position of any point of a reflecting or refracting surface, and R is a target position on the light-receiving surface, the light beam starts from O to reach an optical surface O', and is refracted or reflected to reach the target point R, when the coordinate origin O in the Cartesian coordinate system is a center of the C-γ spherical coordinate system, any point O' on the free-form surface can be expressed as ρ(C, γ), the angle C is an included angle between the projection of a vector OO' on a XOY plane and the positive direction of the X-axis, and the angle γ is an included angle between the vector OO' and the positive direction of the Z axis: when the point O' is the center of the spherical coordinate system, a reflected light beam vector O'R can be expressed as ρ(θ, φ), wherein the angle θ is an included angle between the projection of the vector O'R on the XOY plane and the positive direction of the X-axis, the angle φ is an included angle between the vector O'R and the positive direction of the Z-axis, when the point O' is an arbitrary point on the free-form surface, which can be expressed as O(x, y, z) in the three-dimensional Cartesian coordinate system, and expressed as ρ(C, γ) in the spherical coordinate system, in the case of axial symmetric (θ−C)=0 or a constant, wherein the creation of a plane curve set of the first refractive curved surface and the second refractive curved surface set of the side surface portion of the light source refracting unit is defined by the following differential equation:

$$\frac{\partial\rho}{\partial\gamma}=\rho\frac{n_R\sin\gamma\cos\varphi-n_R\cos\gamma\sin\varphi\cos(\theta-C)}{n_R\cos\gamma\cos\varphi+n_R\sin\gamma\sin\varphi\cos(\theta-C)-n_I}$$

when (θ−C) is a constant, the equation represents the plane curve on the plane comprising the light-emitting main axis, the created plane curve of a plurality of different positions compose sectional curve sets of the first refractive curved surface and the second refractive curved surface, the first refractive curved surface and the second refractive curved surface set are respectively constructed by the sectional curve sets, wherein $n_I$, $n_R$ are respectively refractive indexes of a medium where an incident light and an emergent light are, when it is refracted, $n_I \neq n_R$, and the relationship between γ and φ is governed by the law of conservation of energy to determine the unique relationship between the two, so that the γ and φ variables become dependent, and the equation can be uniquely solved to determine the form of illuminance distribution on the light-receiving surface, and transfer the energy of the light source to the light-receiving surface for obtaining a set light intensity distribution.

9. The light source guiding device as claimed in claim 1, wherein further comprising a light source shielding unit, the light source shielding unit being disposed at an edge of the light source reflecting unit facing the light source refracting unit, and surrounding a portion of the light source refracting unit, a geometric shape of the light source shielding unit shielding a part of the light beam of the light source leaked from a gap between the light source refracting unit and the light source reflecting unit without being refracted or reflected.

10. The light source guiding device as claimed in claim 1, wherein further comprising a side refracting unit, the side refracting unit being disposed at an edge of the light source reflecting unit facing the light source refracting unit, a geometric shape of the side refracting unit corresponding to a configuration of the light source refracting unit so that the light beam leaked from a part of the configuration of the light source reflecting unit not corresponding to the light source refracting unit being incident toward the direction of the light source refracting unit.

* * * * *